US006756862B2

(12) United States Patent
Bois et al.

(10) Patent No.: US 6,756,862 B2
(45) Date of Patent: Jun. 29, 2004

(54) SIX-DROP BUS WITH MATCHED RESPONSE

(75) Inventors: Karl Joseph Bois, Fort Collins, CO (US); David W. Quint, Fort Collins, CO (US); David John Marshall, Fort Collins, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/177,042

(22) Filed: Jun. 21, 2002

(65) Prior Publication Data

US 2003/0234702 A1 Dec. 25, 2003

(51) Int. Cl.[7] ..... H01P 5/12
(52) U.S. Cl. ..... 333/125
(58) Field of Search ..... 333/125, 25, 105, 333/17.3; 326/30, 86; 327/108; 375/257, 258; 710/19

(56) References Cited

U.S. PATENT DOCUMENTS 4,882,554 A * 11/1989 Akaba et al. ..... 333/105
5,949,825 A * 9/1999 Naffziger ..... 375/257
6,191,663 B1 * 2/2001 Hannah ..... 333/17.3
6,356,106 B1 * 3/2002 Greeff et al. ..... 326/30

* cited by examiner

*Primary Examiner*—Patrick Wamsley
(74) *Attorney, Agent, or Firm*—Alexander J. Neudeck

(57) ABSTRACT

A six-drop bus has each driver or receiver terminated at the characteristic impedance of $Z_0$. Each driver or receiver is connected to a segment of transmission line with a characteristic impedance of $Z_0$. Three of these segments are connected at a first point. The other three of these segments are connected at a second point. The first and second points are connected by a central transmission line with a characteristic impedance of $Z_0/3$.

17 Claims, 1 Drawing Sheet

SIX-DROP BUS WITH MATCHED RESPONSE

CROSS-REFERENCE TO RELATED APPLICATIONS

A related copending United States patent application commonly owned by the assignee of the present document and incorporated by reference in its entirety into this document is being filed in the United States Patent and Trademark Office on or about the same day as the present application. This related application is, Ser. No. 10/176,833, and is titled "FOUR-DROP BUS WITH MATCHED RESPONSE."

FIELD OF THE INVENTION

This invention relates generally to data communication and more particularly to a transmission line structure for bi-directional communication between six sources/receivers.

BACKGROUND OF THE INVENTION

In many communication systems, such as digital data sent between integrated circuits, a driver send electrical waveforms to a receiver. To accomplish this, the signal may have to propagate through a series of transmission lines. To minimize reflections, these transmission lines are often constructed such that their characteristic impedance ($Z_0$) is the same as the driver impedance, the receiver impedance, or both. For high-speed connections, it is desirable for the driver, receiver, and the transmission line to all have the same impedance. This helps produce a system where there are no reflections on the transmission line or its ends. For the simplest case of one driver connected to one receiver, matching the driver and receiver and transmission line is quite simple.

Unfortunately, where a driver sends a signal along a transmission line to several receivers (or integrated circuits), producing a system with no reflections becomes more difficult. These systems (or busses) are typically called multi-drop busses.

Multi-drop busses typically generate multiple reflections because of impedance mismatches at each transmission line branch or each receiver. These multiple reflections can combine in complex ways thereby making design of the whole system difficult and complex. Often, a design that has to deal with these multiple reflections will require segments of transmission lines with many different characteristic impedances. This further complicates the design and layout of the system.

SUMMARY OF THE INVENTION

A six-drop bus has each driver or receiver terminated at the characteristic impedance of $Z_0$. Each driver or receiver is connected to a segment of transmission line with a characteristic impedance of $Z_0$. Three of these segments are connected at a first point. The other three of these segments are connected at a second point. The first and second points are connected by a central transmission line with a characteristic impedance of $Z_0/3$.

DETAILED DESCRIPTION OF THE PREFERRED EMBODIMENTS

Figure 1:
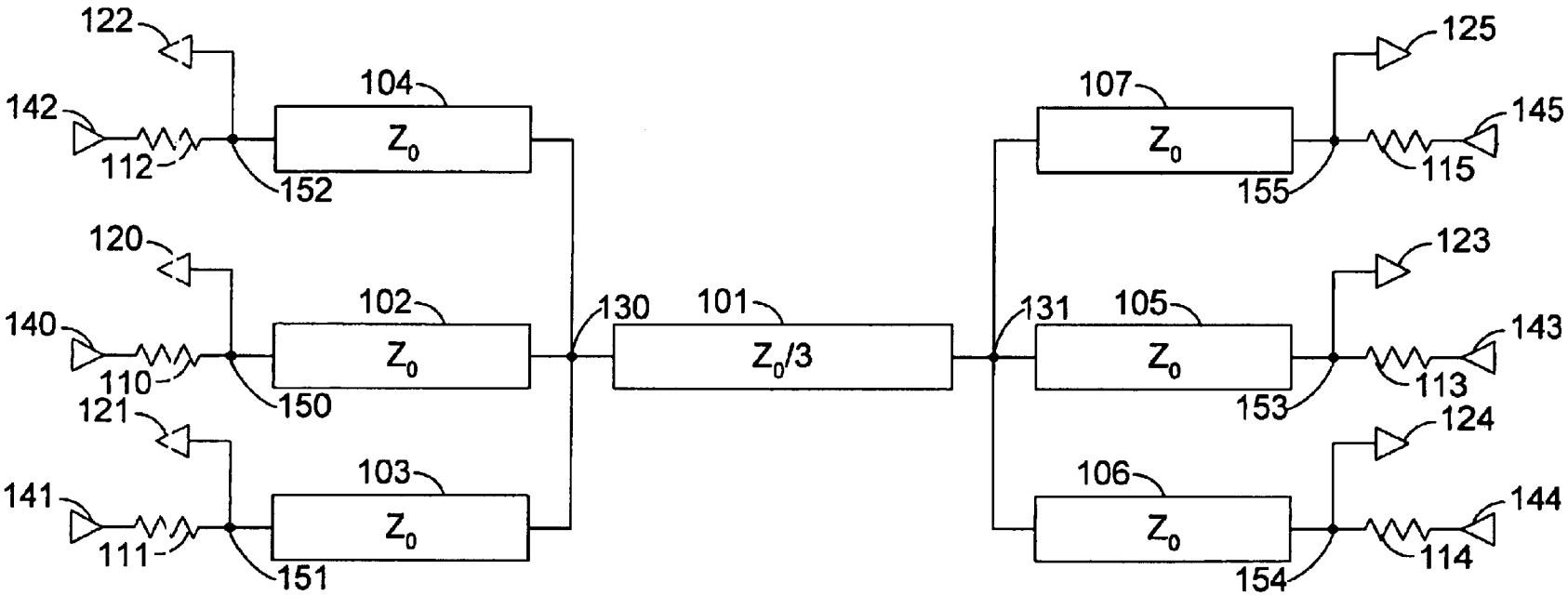
FIG. 1 is an illustration of a six-drop bus with matched response.

In FIG. 1, transmission line 101 has a characteristic impedance of one-third times Z0. This may also be written as Z0/3. Z0 is an arbitrary characteristic impedance value that may be chosen with great latitude by the designer of the board or system by adjusting various board design parameters such as trace width, trace spacing, board layer thickness, etc, to fit a variety of constraints such as manufacturability, space, cost, or similarity to other impedances such as a driver impedance or termination impedance. Likewise, creating a transmission line with an impedance of Z0/3 can be done by adjusting various board design parameters such as trace width, trace spacing, board layer thickness, etc. Another way to create a transmission line of Z0/3 is to connect three transmission lines with characteristic impedance of Z0 in parallel. Transmission line 101 ends at interface node 130 on one end and interface node 131 on the other. Transmission line 101 may also be referred to as the central transmission line.

Connected to transmission line 101 at interface node 130 are transmission lines 102, 103, and 104. Transmission lines 102, 103 and 104 all have a characteristic impedance of $Z_0$. The other end of transmission line 102, node 150, is connected to termination impedance 110 and receiver 120. The other end of transmission line 103, node 151, is connected to termination impedance 111 and receiver 121. The other end of transmission line 104, node 152, is connected to termination impedance 112 and receiver 122. The other terminal of termination impedances 110, 111, and 112 are shown connected to drivers 140, 141, and 142, respectively.

Connected to transmission line 101 at interface node 131 are transmission lines 105, 106, and 107. Transmission lines 105, 106, and 107 all have a characteristic impedance of $Z_0$. The other end of transmission line 105, node 153, is connected to termination impedance 113 and receiver 123. The other end of transmission line 106, node 154, is connected to termination impedance 114 and receiver 124. The other end of transmission line 107, node 155, is connected to termination impedance 115 and receiver 125. The other terminal of termination impedances 113, 114, and 115 are shown connected to drivers 143, 144, and 145, respectively.

Alternatively, drivers 140–145 may, in any combination, be replaced by a low impedance voltage source such as a power supply voltage or a termination supply voltage. Also, drivers 140–145 may be controlled to always be driving a low impedance voltage or may themselves be controlled impedance drivers. In the case where drivers 140–145 are controlled impedance drivers, termination impedances 110–115 may not be needed.

Transmission lines 101–107 may be of different and arbitrary lengths or delays. Assuming that drivers 140–145 have sufficiently low impedance, termination impedances 110–115 are preferably chosen to match the characteristic impedance $Z_0$. If drivers 140–145 are controlled impedance drivers, the controlled impedance of these drivers would preferably be chosen to match the characteristic impedance $Z_0$.

Using the six-drop bus shown in FIG. 1 will result in reflections that are the same independent of which driver 140–145 is driving and which receiver 120–125 is receiving. For example, if driver 140 drives a low impedance step voltage from zero to $V_{in}$, all the termination resistors have an impedance of $Z_0$, and drivers 141–145 are at a low impedance state to a termination supply, then the voltage at node 150 is a step from zero to $V_{in}/2$. This step waveform propagates through transmission line 102 until it reaches interface node 130. At interface node 130, the load seen by transmission line 102 is equivalent to the characteristic impedance of three transmission lines 101, 103, and 104 all in parallel. This equivalent impedance is $0.2*Z_0$. Calculating the reflection coefficient for this equivalent load yields:

$$\Gamma = \frac{0.2 \cdot Z_0 - Z_0}{0.2 \cdot Z_0 + Z_0} = -\frac{2}{3}$$

Therefore, a step of $-V_{in}/3$ will be reflected back down transmission line 102 toward node 150 and a step of $V_{in}/6$ will be transmitted down transmission lines 103, 104 and 101. The wave reflected back down transmission line 102 is absorbed by the matched termination impedance 110 so this wave is not reflected at node 150. Accordingly, node 150 has a final voltage of $V_{in}/6$. Likewise, the $V_{in}/6$ waves propagated down transmission line 103 and 104 are absorbed by the matched termination impedance 111 and 112, respectively, so these waves are not reflected at node 151 and node 152. Accordingly, nodes 151 and 152 both have a final voltage of $V_{in}/6$.

The $V_{in}/6$ wave propagated down transmission line 101 eventually reaches interface node 131. At interface node 131, the load seen by transmission line 101 is equivalent to the characteristic impedance of transmission lines 105, 106, and 107 all in parallel. This equivalent impedance is $Z_0/3$. Calculating the reflection coefficient for this equivalent load yields:

$$\Gamma = \frac{\frac{1}{3}Z_0 - \frac{1}{3}Z_0}{\frac{1}{3}Z_0 + \frac{1}{3}Z_0} = 0$$

Accordingly, there is no reflection at interface node 131 and step waves of $V_{in}/6$ are propagated down transmission lines 105, 106, and 107. The $V_{in}/6$ waves propagated down transmission lines 105, 106, and 107 are absorbed by the matched termination impedances 113, 114, and 115, respectively, so these waves are not reflected at nodes 153, 154, and 155. Accordingly, nodes 153, 154 and 155 all have a final voltage of $V_{in}/6$.

Note that even though the voltage at each node is not the full swing voltage of $V_{in}$, the voltage at each receiver node is the same and no reflections are observed at the receivers. This reduces the complexity of the system design and bus timing. Also note that this exercise could be conducted by driving the input waveform from any of the drivers 140–145 and the outcome of a final voltage of $V_{in}/6$ at each of nodes 150–155 would result.

Finally, note that due to design constraints or manufacturing process issues, the characteristic impedances of the transmission lines 101–107, the termination impedances 110–115 may not be their exactly specified values of $Z_0$ or $Z_0/2$. However, it should be sufficient that these impedances be approximately their specified values. A range of plus or minus 10% should be sufficiently approximate to satisfy most bus design requirements and still have sufficiently small reflections and final voltages that are sufficiently close to $V_{in}/6$ for most applications.

What is claimed is:

1. A six-drop bus, comprising:

a central transmission line having a first characteristic impedance, a first end and a second end;

a first three transmission lines having approximately three times said first characteristic impedance and connected to said first end, each of said first three transmission lines terminated by termination impedances that are approximately three times said first characteristic impedance; and, a second three transmission lines having approximately three times said first characteristic impedance and connected to said second end, each of said second three transmission lines terminated by termination impedances that are approximately three times said first characteristic impedance.

2. The six-drop bus of claim 1 wherein at least one termination impedance is connected to a driver.

3. The six-drop bus of claim 1 wherein at least one termination impedance is a controlled impedance driver.

4. The six-drop bus of claim 1 wherein at least one termination impedance is connected to a low impedance supply voltage.

5. The six-drop bus of claim 1 wherein said central transmission line comprises three transmission lines connected in parallel.

6. A six-drop bus, comprising:

a first transmission line being driven by a first impedance with a first impedance value at a first end and connected to a second, a third and a fourth transmission line at a second end;

said second transmission line being connected to said first transmission line at a first end and terminated at a second end by a second impedance with approximately said first impedance value;

said third transmission line being connected to said first transmission line at a first end and terminated at a second end by a third impedance with approximately said first impedance value;

said fourth transmission line being connected to said first transmission line at a first end and connected at a second end to a fifth, a sixth, and a seventh transmission line;

said fifth transmission line being connected to said fourth transmission line at a first end and terminated at a second end by a fourth impedance with approximately said first impedance value;

said sixth transmission line being connected to said fourth transmission line at a first end and terminated at a second end by a fifth impedance with approximately said first impedance value;

said seventh transmission line being connected to said fourth transmission line at a first end and terminated at a second end by a sixth impedance with approximately said first impedance value; and wherein said first, second, third, fifth, sixth, and seventh transmission lines have characteristic impedances that approximate said first impedance value and said fourth transmission line has a characteristic impedance that approximates one-third said first impedance value.

7. The six-drop bus of claim 6 wherein at least one of said second, third, fifth, sixth, and seventh transmission line is terminated by said second, third, fourth, fifth, and sixth impedance, respectively, connected to a driver.

8. The six-drop bus of claim 6 wherein at least one of said second, third, fifth, sixth, and seventh transmission line is terminated by a controlled impedance driver.

9. The six-drop bus of claim 6 wherein at least one of said second, third, fifth, sixth, and seventh transmission line is terminated by said second, third, fourth, fifth, and sixth impedance, respectively, connected to a low impedance supply voltage.

10. The six-drop bus of claim 6 wherein said third transmission line comprises three transmission lines connected in parallel.

11. A bus for connection to six devices, comprising:

six termination impedances each connected to one of six transmission lines at a first end, a second end of a first three of said six transmission lines connected to a central transmission line at a first end of said central transmission line, and a second end of a second three of said six transmission lines connected to said central transmission line at a second end of said central transmission line; and, wherein said six termination impedances and a characteristic impedance of said six transmission lines are approximately a first impedance value and said central transmission line has a central characteristic impedance that is approximately one-third said characteristic impedance of said six transmission lines.

12. The bus for connection to six devices of claim 11 wherein at least one of said six termination impedances is connected to a driver.

13. The bus for connection to six devices of claim 11 wherein at least one of said six termination impedances is a controlled impedance driver.

14. The bus for connection to six devices of claim 11 wherein at least one of the six termination impedances is connected to a low impedance supply voltage.

15. The bus for connection to six devices of claim 11 wherein said central transmission line comprises three transmission lines connected in parallel.

16. A method of propagating a signal to five receivers, comprising:

propagating a signal into a first end of a first transmission line having a characteristic impedance through a drive impedance wherein said drive impedance approximates said characteristic impedance;

propagating said signal from a second end of said first transmission line into a first end of a second transmission line having approximately said characteristic impedance, a first end of a third transmission line having approximately said characteristic impedance, and a first end of a central transmission line having approximately one-third said characteristic impedance;

absorbing said signal at a second end of said second transmission line with an impedance that approximates said characteristic impedance;

absorbing said signal at a second end of said third transmission line with an impedance that approximates said characteristic impedance;

propagating said signal from a second end of said central transmission line into a first end of a fourth transmission line having approximately said characteristic impedance, a first end of a fifth transmission line having approximately said characteristic impedance, and a first end of a sixth transmission line having approximately said characteristic impedance;

absorbing said signal at a second end of said fourth transmission line with an impedance that approximates said characteristic impedance;

absorbing said signal at a second end of said fifth transmission line with an impedance that approximates said characteristic impedance;

absorbing said signal at a second end of said sixth transmission line with an impedance that approximates said characteristic impedance; and, detecting a voltage at said second end of said second, third, fourth, fifth and sixth transmission lines.

17. The method of claim 16 wherein said step of propagating said signal into said first end of said central transmission line comprises propagating said signal into a first end of a first central transmission line and a first end of a second central transmission line and a first end of a third central transmission line and said step of propagating said signal from said second end of said central transmission line comprises propagating said signal from a second end of said first central transmission line and a second end of said second central transmission line and a second end of said third central transmission line.

* * * * *